US005217300A

United States Patent [19]

Lwery

[11] Patent Number: 5,217,300

[45] Date of Patent: Jun. 8, 1993

[54] TROUBLE LIGHT WITH ADJUSTABLE HOOK AND CORD REEL

[76] Inventor: A. J. Lwery, 867 Sandell, Forth Worth, Tex. 76108

[21] Appl. No.: 876,052

[22] Filed: Apr. 28, 1992

[51] Int. Cl.[5] ..... F21V 21/08

[52] U.S. Cl. ..... 362/387; 362/396; 362/260; 362/270; 362/285; 362/185; 362/186; 362/217

[58] Field of Search ..... 362/387, 396, 427, 458, 362/260, 270, 285, 185, 186, 217, 404, 407, 408, 368, 376

[56] References Cited

U.S. PATENT DOCUMENTS

| | | | |
|---|---|---|---|
| 2,085,683 | 6/1937 | McGill | 362/396 |
| 2,465,414 | 3/1949 | Abshire | 362/396 |
| 3,809,883 | 5/1974 | Goodwin | 362/376 |
| 3,828,181 | 8/1974 | Goodwin | 362/269 |
| 4,019,047 | 4/1977 | Frey | 362/396 |
| 4,321,660 | 3/1982 | Sokol | 362/296 |
| 4,369,487 | 1/1983 | Carlow | 362/387 |
| 4,458,304 | 7/1984 | Imsdahl | 362/387 |
| 4,581,688 | 4/1986 | Tryar | 362/285 |
| 4,644,456 | 2/1987 | Lydell | 362/376 |

*Primary Examiner*—Ira S. Lazarus
*Assistant Examiner*—L. Heyman
*Attorney, Agent, or Firm*—James E. Bradley

[57] ABSTRACT

A trouble light has a positionally adjustable hook and also may carry a rotatable cord reel. The trouble light has a shield that mounts to a base and extends alongside a light source. An elongated slot extends through the shield. A hook for hanging the trouble light has a shank that extends through and is slidable along the slot. A securing device will secure the shank to the shield at selected points and at selected angular orientations. A cord reel mounts to the shank and is rotatable relative to the shank.

34 Claims, 3 Drawing Sheets 55
57
39
47
49
59
21
17
19
25
63
51
41
61
43
23
33
27
37
29
31
45
35
15
11
13
67
69
65

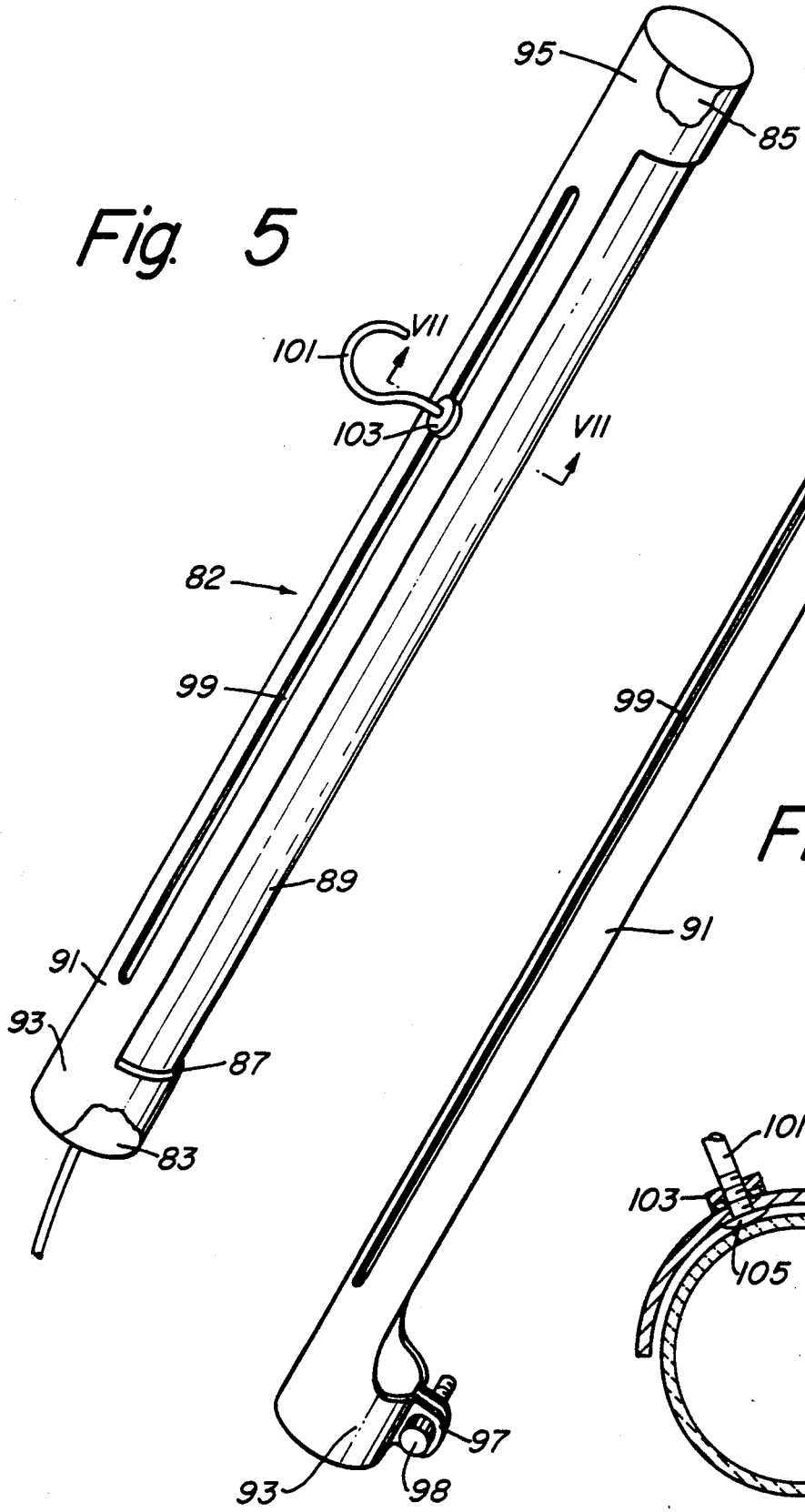
Fig. 5
Fig. 6
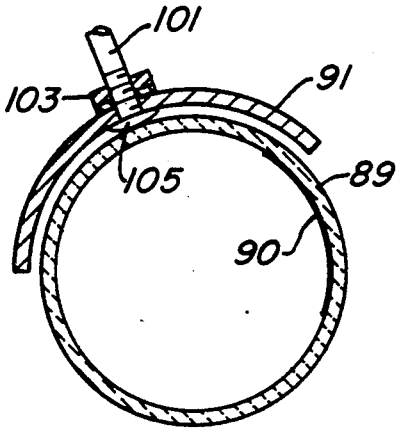
Fig. 7

TROUBLE LIGHT WITH ADJUSTABLE HOOK AND CORD REEL

BACKGROUND OF THE INVENTION

1. Field of the invention

This invention relates in general to extension cord lights, commonly known as trouble lights, used by mechanics and others.

2. Description of the Prior Art

Trouble lights are widely used for illuminating a confined darkened area, usually to perform work or inspect. For example, mechanics use trouble lights to illuminate the confines of an engine compartment or components under the vehicle. A typical trouble light includes a long extension cord, and will have a hook to hang it on a convenient place while in use.

There are two main types of trouble lights, the incandescent type and the fluorescent type. In the incandescent type, the trouble light has a base with a receptacle for receiving an incandescent light bulb. A shield extends upward from the base and curves around a rear side of the light bulb. The shield directs the light in a forward direction. A wire cage extends over the light bulb on the forward side of the shield, and is normally hinged to the shield to provide access to the bulb. The hook extends axially upward from the shield.

One problem is that the hook is normally free to rotate. Because of twisting of the electrical cord, it is often difficult to keep the light bulb and shield oriented in the desired direction. If the hook is freely rotatable, the twist of the cord may cause the shield to move back into another position.

Some trouble lights have means for holding the hook in various angular orientations relative to the shield. One type provides a spring loaded shank on the hook and detents on the shield to cause the hook to lock into various angular positions. For example the detent positions may be 45 degrees apart. While this may work to some extent, with stiff electrical cords, the detent tends to fail to hold the hook in the desired angular position.

Another type proposed in U.S. Pat. No. 4,581,688, Edmund A. Trygar, Apr. 8, 1986, employs a spring and an upward facing prong on the end of the shank for engaging holes spaced around the top of the shield. Again, while this would appear to retain the hook in a desired orientation, it would not be infinitely adjustable. The preciseness of the positioning depends on how many holes are provided.

Fluorescent tube trouble lights have two spaced apart bases, with a fluorescent tube extending between them. A strip along an interior side of the tube is coated with an opaque coating to direct the light. The hook normally is located on the end of one of the bases supporting the tube. Some employ detents and spring biased shanks on the hooks. The detents do not always provide sufficient strength to retain the fluorescent tube directed toward the desired position Another problem that exists with most trouble lights occurs during storage when not in use. The electrical cord may be 25 to 50 feet long typically. Normally it will be just wrapped around the shield or coiled when the trouble light is stored. The cord frequently will tangle. Prior patents have proposed various mechanisms for winding a cord for a storage position, but improvements are desired.

SUMMARY OF THE INVENTION

In this invention, the hook has a shank that is threaded and has a retainer on its end. The retainer locates on the inside of the shield. A hand tightening nut allows the hook to be tightened to any angular position relative to the shield.

Preferably, the aperture for the hook shank is an elongated slot In one embodiment, the slot has both an axial portion and a lateral portion. The slot allows the hook to be positioned at different orientations relative to the shield to direct the light.

In another embodiment, a cord reel mounts to the shank. The cord reel has a central plate with a hole through which the shank extends. When the nut is loosened, the cord reel may be rotated to wind and unwind the cord.

BRIEF DESCRIPTION OF THE DRAWINGS

FIG. 5 is a perspective view of a second alternate embodiment of the invention, showing a fluorescent trouble light an adjustable hook and slot being incorporated with a shield.

FIG. 6 is a perspective view of the shield that mounts to the fluorescent tube trouble light of FIG. 5.

FIG. 7 is a sectional view of the trouble light of FIG. 5, taken along the line VII—VII of FIG. 5.

DETAILED DESCRIPTION OF THE INVENTION

Figure 1:
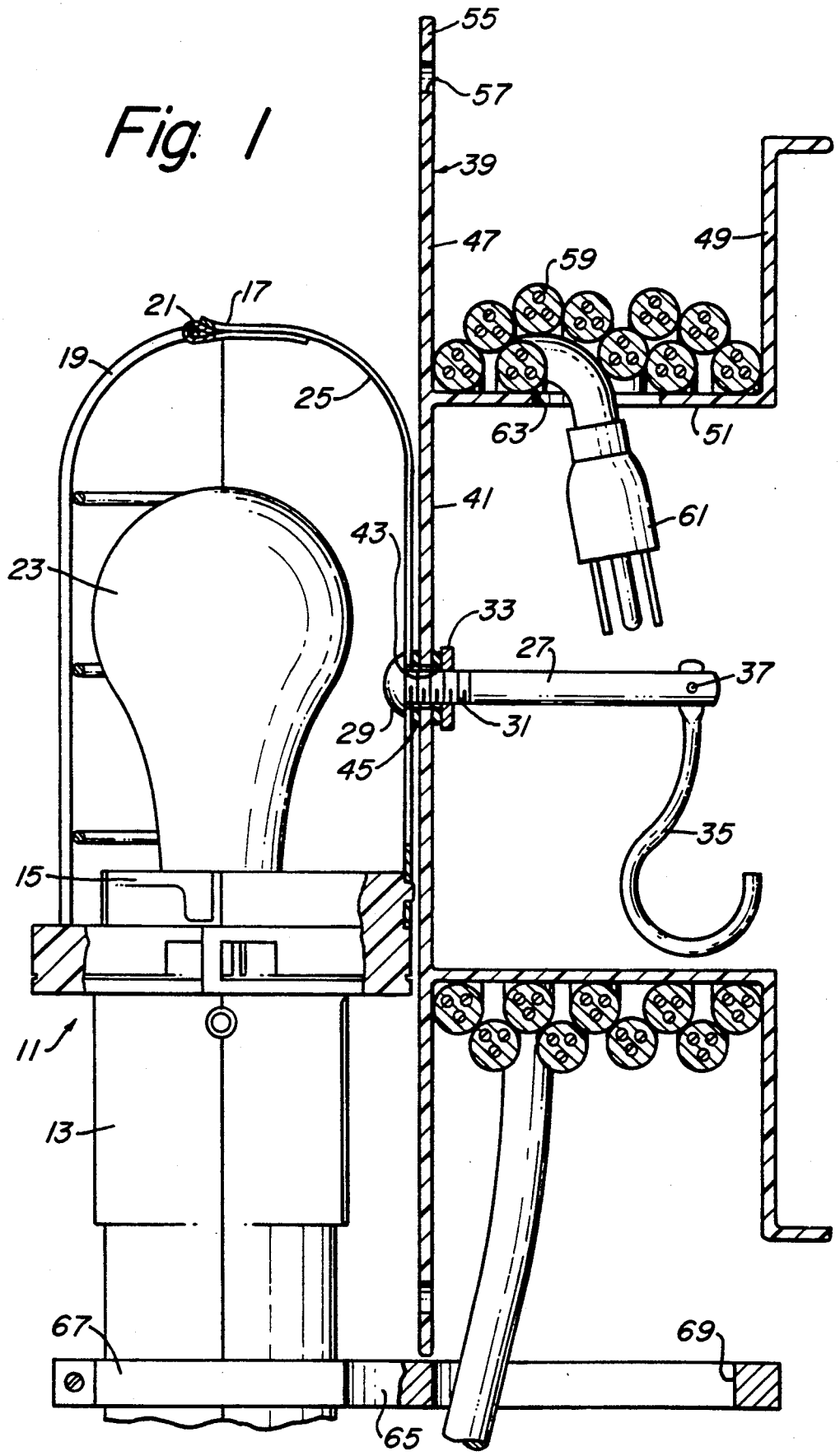
FIG. 1 is a partial vertical sectional view illustrating a first embodiment of a trouble light constructed in accordance with this invention.

Referring to FIG. 1 trouble light 11 has a tubular base 13 An electrical receptacle 15 locates on an upper end of base 13. A shield 17, which may be either metal or plastic, secures to base 13. Shield 17 has a lower portion that is generally semicylindrical. An upper portion curves over in a spherical configuration, providing a hood or convex configuration. Shield 17 will be solid and either of metal or plastic for directing light in a forward direction away from shield 17.

A wire cage 19, which may be either metal or plastic, secures by a hinge 21 to the upper end of shield 17. Cage 19 extends forward of shield 17 and has a lower end that releasably secures to base 13. Cage 19 encloses an incandescent bulb 23. Hinge 21 allows cage 19 to be opened for access to bulb 23.

An elongated slot 25 extends along shield 17. Slot 25 is a narrow aperture, as illustrated also in FIG. 3, extending from near base 13 to near the hinge 21. An axial portion **25*a* of slot 25 will extend up to approximately where the longitudinal axis of receptacle 15 intersects shield 17. Axial portion 25*a* is in a plane parallel to the axis of receptacle 15. At the lower end, a lateral portion 25*b* extends laterally, perpendicular to portion 25*a***.

A shank 27 extends slidingly through slot 25. Shank 27 is a metal member having a retainer head 29 on one end. In the embodiment shown, retainer head 29 is a round, flat head integrally formed on shank 27. Retainer head 29 has a diameter that is greater than the width of slot 25.

A plurality of threads 31 extend on shank 27 outward from retainer head 29. A nut 33 will engage threads 31 to tighten shank 27 to shield 17. Nut 33 may be knurled to facilitate use by fingers of the user.

Figure 2:
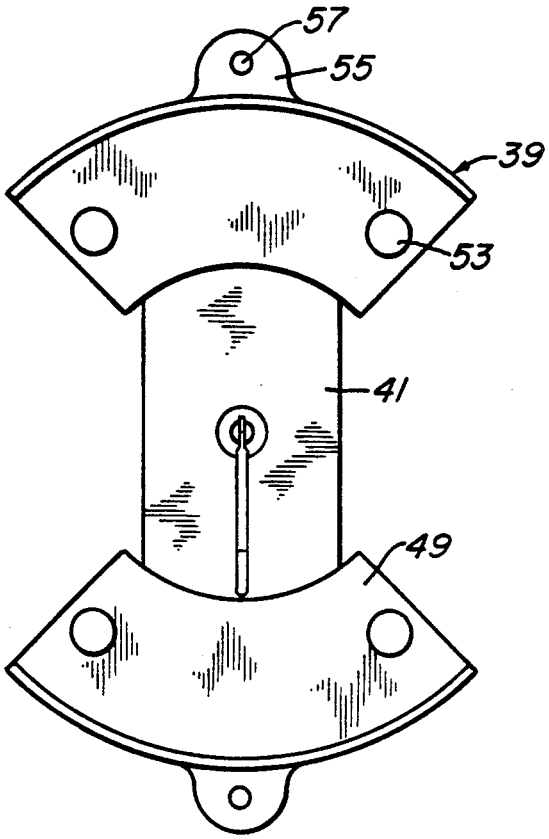
FIG. 2 is a side elevational view of the cord reel that mounts to the trouble light of FIG. 1.

A hook 35 is located on the outer end of shank 27, opposite retainer head 29. In the embodiment of FIGS. 1 and 2, hook 35 pivotally connects to shank 27 by means of a pivot pin 37. Hook 35 moves between a folded storage position shown in FIG. 1 to an operational position. In the operational position, the portion of hook 35 that connects to shank 27 will be axially aligned with shank 27, causing hook 35 to protrude further outward.

In the embodiment of FIG. 1, a cord reel 39 mounts to shank 27. Cord reel 39 has a central plate 41 that extends parallel to the longitudinal axis of 1, receptacle 15. Central plate 41, shown also in FIG. 2, has a hole 43 through its center. Shank 27 will extend through hole 43. A washer 45 located between central plate 41 and shield 17 positions central plate 41 a slight distance from shield 17. A similar washer locates between nut 33 and central plate 41. Tightening nut 33 will tighten central plate 41 to prevent rotation of reel 39, while loosening nut 33 will allow reel 39 to be rotated.

Reel 39 has two inner flanges 47, shown also in FIG. 2. Inner flanges 47 are contained in the same plane with central plate 41. Inner flanges 47 are segments of a circle, each extending about 90 degrees. Inner flanges 47 are spaced 180 degrees opposite each other.

Reel 39 also has two outer flanges 49 which are segments of circles, each extending about 90 degrees. The centerlines of each outer flange 49 are 180 degrees apart from each other. A hub 51 connects the two inner flanges 47 with the two outer flanges 49. Hub 51 is a segment of a cylinder, having two 90 degree portions, spaced apart from each other in the same manner as the flanges 47, 49.

Reel 39 has one or more knobs 53 (four shown) which protrude outward from outer flange 49. Knobs 53 are integrally formed thereon and are to be gripped by a user for rotating reel 39. The four knobs 53 shown are spaced at edges of the outer flanges 49 and will support the reel 39 in a horizontal position if laid flat with knobs 53 facing downward. Two tabs 55, shown in FIG. 2, extend upward from inner flanges 47. Each tab 55 has an aperture 57. Tab 55 can be used to hang the trouble light 11 for storage.

Referring again to FIG. 1, an electrical cord 59 winds around the hub 51 of reel 39. Electrical cord 59 locates between the flanges 47, 49. A plug 61 on one end will extend through a hole 63 formed in one of the sections of hub 51.

A cord guide 65 mounts stationarily to base 13 for guiding electrical cord 59 while it is being wound onto reel 39. Cord guide 65 has a clamp 67 which clamps cord guide 65 to base 13. A lateral portion extends outward adjacent the edges of reel 39. A guide hole 69 allows electrical cord 59 to pass through cord guide 65 while it is being wound onto reel 39.

Figure 3:
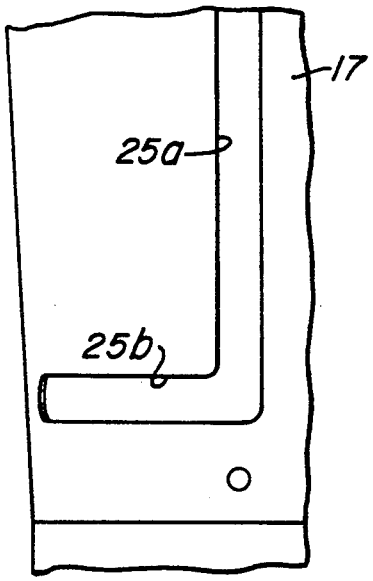
FIG. 3 is a side view of a portion of the shield of the cord reel of FIG. 1, shown with the cord reel removed.

In the operation of the embodiment of FIGS. 1-3, the user will first remove electrical cord 59 from reel 39. He will do this by loosening nut 33 and pulling the cord 59 from reel 39 as reel 39 rotates.

Then, the operator will move hook 35 from the collapsed position shown in FIG. 1 to an operational position. In the operational position, hook 35 will protrude outward past the outer flange 49 of reel 39. The user will decide the best orientation of hook 35 relative to base 13. The user may wish to leave hook 35 extending laterally outward from the axis of receptacle 15, as shown in FIG. 1 If so, the user will simply tighten nut 33 and place hook 35 over some object. If the user wishes to change the position, he will loosen nut 33 and slide shank 27 along slot 25. The user may wish to slide it into lateral portion 25*b* (FIG. 3). Alternately, the user may wish to slide shank 27 further upward. The user may slide shank 27 upward to a position in which it is substantially coaxial with the longitudinal axis of receptacle 15.

While moving shank 27, the empty reel 39 will move with shank 27. The user also selects the angular orientation of hook 35 about the longitudinal axis of shank 27. The angular orientation may be set by rotating hook 35 about the axis of shank 27 until reaching a desired position Then the user simply tightens nut 33. After use, the cord 59 may be rewound by reversing the procedure. The user will utilize one of the knobs 53 to rotate reel 39.

Figure 4:
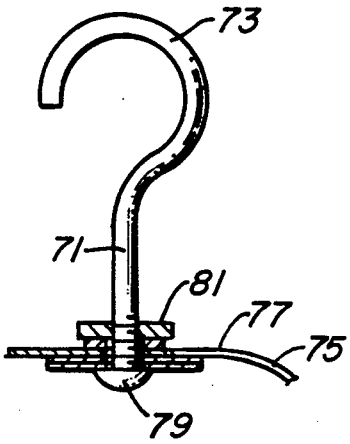
FIG. 4 is a partial sectional view illustrating a first alternate embodiment for a hook used with the trouble light of FIG. 1.

FIG. 4 illustrates a second embodiment In this embodiment, reel 39 is not utilized. Also, the hook 35 of FIG. 1 is not pivotal relative to shank 27. Rather shank 71 and hook 73 of FIG. 4 are integrally formed with each other Otherwise, the remaining structure will be the same. Shank 71 extends through a slot 25 in shield 77. A retainer head 79 is integrally formed on shank 71 and locates on the inside of shield 77. A nut 81 will selectively tighten hook 73 in the desired position along slot 75. Also, nut 81 selectively allows hook 73 to be rotated about the axis of shank 71 to a desired position, then tightened in place.

FIGS. 5 and 6 show a third embodiment In this embodiment, the trouble light 82 is of a different type. It utilizes two separate bases 83, 85 separated from each other. Each base 83, 85 is cylindrical and has an electrical receptacle 87. A fluorescent light tube 89 secures in the receptacles 87, connecting the bases 83, 85 together Tube 89 has a coated opaque strip 90 on its interior as shown in FIG. 7.

In this embodiment, shield 91 is a sleeve member that will slide over the trouble light 82. Shield 91 in the preferred embodiment is a generally concave strip. Cylindrical sleeves 93, 95 are located on each end of shield 91. Sleeve 93 has a clamp 97 for clamping shield 91 to the bases 83, 85. Clamp 97 is tightened and loosened by a knurled bolt 98.

An elongated slot 99 extends axially along the shield 91. Slot 99 extends almost the entire distance between the two bases 83, 85. Slot 99 in the embodiment shown is a straight member. However, it could also have a lateral portion.

A hook 101 will secure to shield 91 at selected positions along the slot 99. Hook 101 can slide from one end to the other of slot 99. Hook 101 also can be rotated to various angular positions about its shank. A nut 103 will tighten hook 101 in the desired axial position along slot 99 and in the desired angular position. A retainer 105 (FIG. 7) on the end of the shank of hook 101 retains hook 101 with shield 91. Although not shown, a reel such as reel 39 in FIG. 1 could also be employed with the trouble light 82.

In operation, loosening bolt 98 allows the user to rotate shield 91 relative to the bases 83, 85 to select various positions for opaque strip 90 of light tube 89. Changing the orientation of hook 101 relative to opaque strip 90 will change the direction of the light being emitted from tube 89. Also, in the preferred embodiment, shield 77 cooperates with strip 90 to direct the light in a desired direction. Sliding hook 101 to a desired point along slot 99 also directs the light.

The invention has significant advantages. By utilizing a threaded shank and nut, the user may tighten the hook in any angular position for directing the light in a desired direction. The elongated slot allows the light to be positioned at various orientations. The cord reel conveniently mounts to the shield. It rotates to facilitate winding the cord.

While the invention has been shown in only three of its forms, it should be apparent to those skilled in the art that it is not so limited, but is susceptible to various changes without departing from the scope of the invention.

I claim:

1. In a trouble light having a base with at least one electrical receptacle for receiving a light source, the improvement comprising in combination:

a shield mounted to the base and extending adjacent the light source;

an elongated slot extending through the shield;

a hook for hanging the trouble light, the hook having a shank extending through and slidable along the slot; and securing means for securing the shank to the shield at selected points along the slot to orient the trouble light in a desired position.

2. The trouble light according to claim 1 wherein the securing means comprises:

a threaded section on the shank; and a nut which engages the threaded section for tightening the shank to the shield.

3. The trouble light according to claim 1 wherein the securing means comprises:

a retainer on an end of the shank opposite the hook, the retainer having a diameter larger than the dimension across the slot, the retainer locating on an inside surface of the shield;

a threaded section on the shank extending from the retainer outward through the slot toward the hook; and a nut which engages the threaded section for tightening the shank to the shield.

4. The trouble light according to claim 1 wherein the receptacle has an axis, and wherein the slot extends parallel to the axis.

5. The trouble light according to claim 1 wherein the receptacle has an axis, and wherein the slot has an axial portion that extends parallel to the axis and a lateral portion that extends from the axial portion perpendicular to the axial portion.

6. The trouble light according to claim 1 wherein the base has two sections spaced apart from each other, wherein there are two of the receptacles, each mounted to one of the sections for receiving a light source, the light source being a fluorescent tube, the receptacles having a common longitudinal axis, and wherein:

the shield extends along the tube between the sections; and the slot extends along the shield parallel to the axis.

7. In a trouble light having a base with an electrical receptacle for receiving a light bulb, the receptacle having an axis, a shield mounted to the base and extending upward along a rear side of the light bulb, the shield being of solid material and curved for directing light from the light bulb in a forward direction, comprising in combination:

an elongated slot extending through the shield;

a hook for hanging the trouble light, the hook having a shank extending through and slidable along the slot; and securing means for securing the shank to the shield at selected points along the slot to orient the trouble light in a desired position.

8. The trouble light according to claim 7 wherein the securing means comprises:

a threaded section on the shank; and a nut which engages the threaded section for tightening the shank to the shield.

9. The trouble light according to claim 7 wherein the securing means comprises:

a retainer on an end of the shank opposite the hook, the retainer having a diameter larger than the dimension across the slot, the retainer locating on an inside surface of the shield;

a threaded section on the shank extending from the retainer through the slot toward the hook; and a nut which engages the threaded section for tightening the shank to the shield, allowing the hook to be selectively rotated to various orientations relative to the shield and tightened in place.

10. The trouble light according to claim 7 wherein the slot extends parallel to the axis.

11. The trouble light according to claim 7 wherein the slot has an axial portion that extends parallel to the axis and a lateral portion that extends from the axial portion perpendicular to the axial portion.

12. In a trouble light having a base with an electrical receptacle for receiving a light source, the improvement comprising in combination:

a shield mounted to the base and extending adjacent the light source for directing the light produced by the light source;

an aperture extending through the shield;

a hook for hanging the trouble light, the hook having a shank extending through the aperture;

a retainer on an end of the shank opposite the hook, the retainer having a diameter larger than the dimension across the aperture, the retainer locating on an inside surface of the shield;

a threaded section on the shank extending from the retainer outward through the aperture toward the hook;

a nut which engages the threaded section for tightening the shank to the shield, allowing the hook to be rotated to a selected orientation relative to the shield and tightened in place; and wherein the aperture is an elongated slot.

13. In a trouble light having a base with an electrical receptacle for receiving a light source, the improvement comprising in combination:

a shield mounted to the base and extending adjacent the light source for directing light produced by the light source;

an aperture extending through the shield;

a hook for hanging the trouble light, the hook having a shank extending through the aperture;

a retainer on an end of the shank opposite the hook, the retainer having a diameter larger than the dimension across the aperture, the retainer locating on an inside surface of the shield;

a threaded section on the shank extending from the retainer outward through the aperture toward the hook;

a nut which engages the threaded section for tightening the shank to the shield, allowing the hook to be rotated to a selected orientation relative to the shield and tightened in place; and wherein the receptacle has an axis, and wherein the aperture is an elongated slot having a portion extending parallel to the axis of the receptacle.

14. In a trouble light having a base with an electrical receptacle for receiving a light source, the improvement comprising in combination:

a shield mounted to the base and extending adjacent the light source for directing light produced by the light source;

an aperture extending through the shield;

a hook for hanging the trouble light, the hook having a shank extending through the aperture;

a retainer on an end of the shank opposite the hook, the retainer having a diameter larger than the dimension across the aperture, the retainer locating on an inside surface of the shield;

a threaded section on the shank extending from the retainer outward through the aperture toward the hook;

a nut which engages the threaded section for tightening the shank to the shield, allowing the hook to be rotated to a selected orientation relative to the shield and tightened in place;

wherein the receptacle has an axis, and wherein the aperture is an elongated slot having an axial portion extending parallel to the axis of the receptacle and a lateral portion extending perpendicular to the axial portion.

15. In a trouble light having a pair of spaced apart bases, each containing an electrical receptacle for receiving between a fluorescent light tube, the light tube having an opaque section extending along its length for directing light from the light tube, the improvement comprising in combination:

a strip mounted to and extending between each of the bases adjacent the light tube;

an elongated slot extending through the strip;

a hook for hanging the trouble light, the hook having a shank extending through and slidable along the slot; and securing means for securing the shank to the shield at selected points along the slot to orient the trouble light in a desired position for the opaque section to direct the light emitted from the light tube.

16. The trouble light according to claim 15 wherein the securing means comprises:

a threaded section on the shank; and a nut which engages the threaded section for tightening the shank to the shield.

17. The trouble light according to claim 15 wherein the securing means comprises:

a retainer on an end of the shank opposite the hook, the retainer having a diameter larger than the dimension across the slot, the retainer locating on an inside surface of the shield;

a threaded section on the shank extending from the retainer outward through the slot toward the hook; and a nut which engages the threaded section for tightening the shank to the shield.

18. The trouble light according to claim 15 further comprising:

mounting means for mounting the strip to the bases for allowing selective rotation of the strip relative to the bases to selectively orient the hook relative to the opaque section.

19. In a trouble light having a base with an electrical receptacle for receiving a light source, the receptacle being connected to an electrical cord, the improvement comprising in combination:

a shield mounted to the base and extending adjacent the light source for directing light produced by the light source;

an aperture extending through the shield;

a hook for hanging the trouble light, the hook having a shank extending through the aperture;

a retainer on an end of the shank opposite the hook, the retainer having a diameter larger than the dimension across the aperture, the retainer locating on an inside surface of the shield;

a threaded section on the shank extending from the retainer outward through the aperture toward the hook;

a nut which engages the threaded section for tightening the shank to the shield, allowing the hook to be rotated to a selected orientation relative to the shield and tightened in place; and a cord reel having an axis of rotation, the cord reel having a central plate containing a hole located on the axis of rotation, the shank of the hook extending through the hole of the cord reel, enabling the cord reel to be rotated relative to the base for cord to be wound on the cord reel for storage and unwound for use.

20. The trouble light according to claim 19 wherein the nut locates outward of the central plate and tightens against the central plate.

21. The trouble light according to claim 19 wherein the hook is pivotally mounted to the shank for folding between a storage position located within the cord reel and an operational position protruding outward from the cord reel.

22. The trouble light according to claim 19 wherein the cord reel has inner and outer flanges separated by a hub for receiving the cord between the flanges and around the hub.

23. The trouble light according to claim 19 wherein the cord reel has inner and outer flanges separated by a hub for receiving the cord between the flanges and around the hub, the inner flange being in two arcuate, segments circumferentially spaced apart, the outer flange being in two arcuate segments circumferentially spaced apart, and the hub being in two arcuate segments circumferentially spaced apart.

24. The trouble light according to claim 19, further comprising cord guide means nonrotatably mounted to the base and extending adjacent the cord reel for guiding the cord as it is wound on the cord reel.

25. The trouble light according to claim 19 wherein the aperture is an elongated slot through which the shank of the hook may slide to selected positions along the slot and be tightened in place with the nut.

26. The trouble light according to claim 19 wherein the receptacle has an axis, and wherein the aperture is an elongated slot having a portion extending parallel to the axis of the receptacle, the shank of the hook being slidable to selected positions along the slot and securable in place with the nut.

27. The trouble light according to claim 19 wherein the receptacle is configured for receiving a light source that is an incandescent light bulb.

28. The trouble light according to claim 19 wherein the receptacle has an axis, and wherein the aperture is an elongated slot having an axial portion extending parallel to the axis of the receptacle and a lateral portion extending perpendicular to the axial portion, the shank of the hook being slidable to selected positions along the slot and securable in place with the nut.

29. In a trouble light having a base with an electrical receptacle for receiving a light source, the receptacle being connected to an electrical cord and having an axis, the improvement comprising in combination:

a shield mounted to the base and extending adjacent the light source for directing light produced by the light source;

an elongated slot extending through the shield parallel to the axis;

a hook for hanging the trouble light, the hook having a shank extending through the slot and being pivotally mounted to the shank for movement between a storage position and an operational position, the hook being slidable to selected positions along the slot;

a cord reel having an axis of rotation, the cord reel having a central plate containing a hole located on the axis of rotation, the shank of the hook extending through the hole of the cord reel, enabling the cord reel to be rotated relative to the base for cord to be wound on the cord reel for storage and unwound for use; and securing means for securing the shank in one of the selected positions, and also for securing the cord reel against rotation.

30. The trouble light according to claim 29 wherein the securing means comprises:

a threaded section on the shank; and a nut which engages the threaded section for tightening the shank and the central plate of the cord reel to the shield.

31. The trouble light according to claim 29 wherein the securing means comprises:

a retainer on an end of the shank opposite the dimension across the slot, the retainer locating on an inside surface of the shield;

a threaded section on the shank extending from the retainer outward through the slot toward the hook; and a nut which engages the threaded section for tightening the shank and the central plate of the cord reel to the shield.

32. The trouble light according to claim 29 wherein the cord reel has inner and outer flanges separated by a hub for receiving the cord between the flanges and around the hub, and wherein the hook locates within the hub when in the storage position and protrudes past the outer flange when in the operational position.

33. The trouble light according to claim 29 wherein the cord reel has inner and outer flanges separated by a hub for receiving the cord between the flanges and around the hub, the inner flange being in two arcuate segments circumferentially spaced apart, the outer flange being in two arcuate segments circumferentially spaced apart, and the hub being in two arcuate segments circumferentially spaced apart, and wherein the hook locates within the hub when in the storage position and protrudes past the outer flange when in the operational position.

34. The trouble light according to claim 29 further comprising cord guide means nonrotatably mounted to the base and extending adjacent the cord reel for guiding the cord as it is wound on the cord reel.

* * * * *

UNITED STATES PATENT AND TRADEMARK OFFICE

CERTIFICATE OF CORRECTION

PATENT NO. : 5,217,300

DATED : June 8, 1993

INVENTOR(S) : A.J. Lowery

It is certified that error appears in the above-indentified patent and that said Letters Patent is hereby corrected as shown below:

On the title page: Item [75] Inventors: should be "A.J. Lowery".

Signed and Sealed this

Nineteenth Day of August, 1997

Bruce Lehman

*Attest:*

BRUCE LEHMAN

*Attesting Officer*

*Commissioner of Patents and Trademarks*